United States Patent [19]

Wiswell et al.

[11] 4,095,209

[45] June 13, 1978

[54] ELECTRICAL RESISTOR AND METHOD OF MAKING SAME

[75] Inventors: H. Eugene Wiswell, Elkhart, Ind.; Danny R. Hardwick, Edwardsburg, Mich.

[73] Assignee: CTS Corporation, Elkhart, Ind.

[21] Appl. No.: 681,479

[22] Filed: Apr. 29, 1976

[51] Int. Cl.[2] ..... H01C 10/34

[52] U.S. Cl. ..... 338/174; 338/184; 338/199; 338/322; 338/328

[58] Field of Search ..... 338/174, 160, 164, 167, 338/184, 188, 192, 199, 312, 313, 322, 324, 328, 329

[56] References Cited

U.S. PATENT DOCUMENTS

| | | | |
|---|---|---|---|
| 3,416,119 | 12/1968 | Van Banthuysen et al. | 338/174 |
| 3,855,565 | 12/1974 | Robinson et al. | 338/174 X |
| 3,997,865 | 12/1976 | George | 338/174 |

*Primary Examiner*—C. L. Albritton

*Attorney, Agent, or Firm*—John J. Gaydos

[57] ABSTRACT

An electrical resistor comprising a base having a resistance element supported thereon. A pair of terminals for connecting the element into an electrical circuit are bonded to the resistance element. The bond comprises a conductive thermoplastic bondable material applied to the resistance element before the terminals are secured thereto. Heat applied to the terminals causes the bondable material to flow and bond the terminals to the resistance element. In one embodiment, a rotatable knob, a contactor and a collector are assembled to the resistor to produce a variable resistance control. The knob is provided with a first skirt extending toward the base and in slideable engagement therewith. The first skirt supports the knob in spaced relationship with the base and a second skirt extends toward the resistance element carried by the base. The distal end of the second skirt is disposed proximate to the resistance element and encloses and protects the resistance element against external contaminants.

9 Claims, 5 Drawing Figures

ELECTRICAL RESISTOR AND METHOD OF MAKING SAME

The present invention relates to electrical resistors and, more particularly, to a variable resistance control provided with bonded terminals and to a method of making the same.

Many variable resistance controls presently manufactured have partially exposed resistance elements. This exposure of the resistance element permits, with passing of time, dirt and other impurities to be deposited upon the contacting surface of the resistance element thereby interfering with the desired continuous contact between the resistance element and the contactor. Enclosed controls including controls having protected elements generally are more expensive. It is therefore desirable to provide a variable resistance control having a protected resistance element.

In prior art controls, such as shown in U.S. Pat. No. 3,947,800, a skirt is provided for protecting the resistance element from dirt, scratches and the like. Although such controls have been satisfactory, the life of such control is limited since continuous rotation of the knob results in wear of the resistance element thereby adversely affecting the electrical characteristics of the control. It would therefore be desirable to provide means for protecting the resistance element without adversely affecting the resistance element during operation of the control.

The prior art describes many methods for securing and electrically connecting terminals to the resistance element of a variable resistance control. When the control is made with highly mechanized and automated equipment, it is preferable to secure the terminals to the resistance elements by folding or crimping a portion of the terminal to the base. Since it is preferable to make the terminals of resilient material, intermittent discontinuities occasionally occur when external forces are applied, such as, for rotating the knob for setting the control. These intermittent conditions indicate potential reliability problems with such controls. It is therefore desirable to provide an improved connection including a bond between the terminals and the resistance element.

The prior art describes many methods to achieve an improved bond of the element to the terminal. One common method is the use of a paste composition of metallic particles and glass frit. Such a technique requires a firing temperature substantially above the temperature a carbon resistance element on a phenolic base can withstand without degradation. Addtionally, the prior art teaches the use of a conductive two part epoxy for bonding of terminals to a resistance element. This approach presents difficulties as the epoxy has a limited potting life, and additionally, the epoxy deteriorates when raised to the curing temperature required for a carbon resistance element thereby requiring application of the epoxy after such curing, such application of the epoxy only after curing of the resistance element requiring extra production steps and increasing the cost of the control. Solderable paints for use with solder have also been employed for improving the bond between the terminals and a carbon resistance element. Difficulties, however, occur since the solderable paints are degraded at the temperatures required for curing the carbon resistance element thereby also requiring application of the solder after curing of the resistance element as with epoxy. Additionally, soldering limits the choice of materials that are useable as terminals and as plating thereof since such material must also be solderable. It is therefore desirable to provide a method of bonding a terminal to a resistance element wherein a bonding material can be applied on the resistance element prior to curing thereof.

Accordingly, it is an object of the present invention to provide a new and improved electrical resistor having the various desirable features set forth above.

Another object of the present invention is to provide a variable resistance control wherein the resistance element is economically protected.

Still another object of the present invention is to provide a variable resistance control having stop means in a knob and provided within the periphery of the knob.

A further object of the present invention is to provide an electrical resistor employing a conductive thermoplastic for improving the bond between the terminals to the resistance element.

Still another object of the present invention is to provide an electrical resistor wherein the bonding material can be applied to the resistance element prior to curing of the element.

A still further object of the present invention is to provide a method for improving the bond between the terminal and the resistance element of an electrical resistor.

Further objects and advantages of the present invention will become apparent as the following description proceeds, and the features of novelty characterizing the invention will be pointed out with particularity in the claims annexed to and forming a part of this specification.

Briefly, the present invention is concerned with an electrical resistor comprising a base having a resistance element supported thereon. A pair of terminals for connecting the element into an electrical circuit are bonded to the resistance element. The bond comprises a conductive thermoplastic bondable material applied to the resistance element before the terminals are secured thereto. Heat applied to the terminals causes the bondable material to flow and bond the terminals to the resistance element. In one embodiment, a rotatable knob, a contactor and a collector are assembled to the resistor to produce a variable resistance control. The knob is provided with a first skirt extending toward the base and in slideable engagement therewith. The first skirt supports the knob in spaced relationship with the base and a second skirt extends toward the resistance element carried by the base. The distal end of the second skirt is disposed proximate to the resistance element and encloses and protects the resistance element against external contaminants. A stop is provided internal to the control for limiting the contactor travel along the resistance element intermediate the ends thereof.

For a better understanding of the present invention, reference may be had to the accompanying drawings wherein the same reference numerals have been applied to like parts and wherein.

Figure 1:
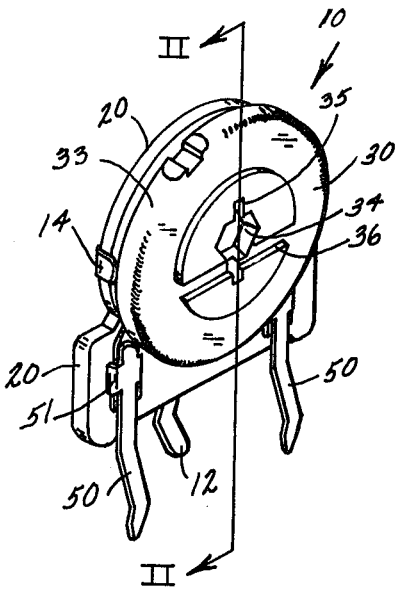
FIG. 1 is an isometric view of a variable resistance control employing the features of the present invention.
Figure 2:
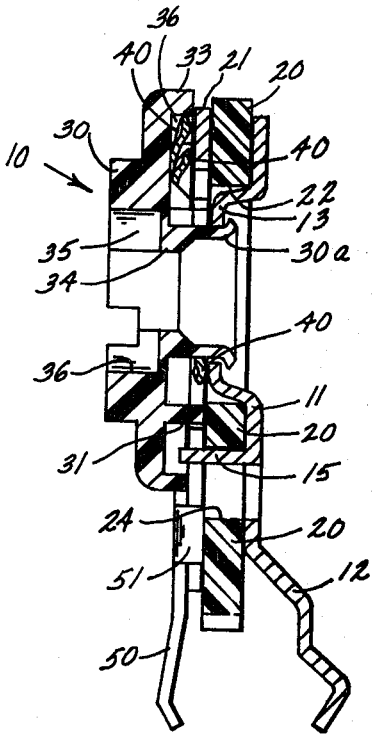
FIG. 2 is a sectional view of the variable resistance control generally taken along lines II—II of FIG. 1.

Referring now to the drawings, there is illustrated a variable resistance control, generally indicated at 10, comprising a combination collector and supported bracket 11 (see FIG. 2), a base 20 carrying an arcuate resistance element 21, a rotatable member or knob 30 rotatably secured to the bracket 11 by a flared bearing 30*a* formed from a shaft integral with the knob 30, a contactor 40 wipably engaging and electrically connecting the resistance element 21 and collector ring 13 formed from the bracket 11, and terminals 50 secured to the resistance element 21 for connecting the resistance element 21 to an external circuit. It is to be understood that the base 20, the resistance element 21 supported thereon, and the terminals 50 secured to the element 21 define an electrical resistor useable in an electrical circuit as a fixed resistor or when assembled with the collector ring 13, the contactor 40, and the knob 30 forms a variable resistance control 10. As best seen in FIG. 2, the bracket 11 comprises a metal stamping having a center terminal 12 extending downwardly from the center portion of the bracket for mounting the control 10 to a printed circuit board or the like. The collector ring 13 is embossed from the center portion of the bracket 11 and extends inwardly thereof into an aperture 22 provided in the base 20 for aligning the base 20 with the bracket 11. Tabs 14 (see FIG. 1) projecting forwardly of the bracket 11 engage notches 23 (see FIG. 4) in the base for preventing relative rotation therebetween. The arcuate resistance element 21 is secured to the base 20 by the terminals 50. The contactor 40 is constrained to rotate with the knob 30 and provides an infinite number of resistance values between the end terminals 50 and the center terminal 12 electrically connected to the collector ring 13. The contactor 40 nested within the knob 30 and constrained to rotate therewith is provided with a pair of diametrically opposed ears 41 received in recesses 32 provided in the knob 30. A first skirt 31 extending from the knob 30 spaces the knob from the base. For a more thorough description of the control shown in FIG. 1, except for the features of the present invention described hereinafter, reference is made to U.S. Pat. Nos. 3,375,478 and 3,855,565 incorporated herein by reference.

The rotatable securement of the knob 30 by the flared bearing 30*a* biases the knob 30 toward the base 20 forcing the skirt 31 against the base 20. The first skirt 31 provides a rotatable thrust bearing for the knob 30 and slideably engages the base 20 inwardly of the resistance element 21. In accord with the present invention, an integral annular peripheral second skirt 33 extends normal to the major plane of the knob 30 toward the resistance element 21. The skirt 33 is approximately the same diameter as the outer diameter of the resistance element 21 preferably with a clearance therebetween of approximately .005 inch thereby enclosing and protecting the contacting surface of the resistance element against contaminants being deposited thereon. Due to production tolerances, biasing of the knob 30 toward the base 20 occasionally causes the skirt 33 to engage lightly against the base 20 and the resistance element 21. Though it is desirable that a small clearance be present, e.g., to permit escape of trapped printed circuit cleaning fluids or the like, such engagement and the resulting minor abrasion of the resistance element have no harmful effects. The knob 30 of suitable material such as nylon is provided with a centrally disposed hexagonal aperture 34 for receiving a complimentary shaped adjusting tool. A slot 35 is provided in the knob for receiving a screw driver blade for positional adjustment of the knob and a slot 36 facilitates orientation of the knob.

Figure 3:
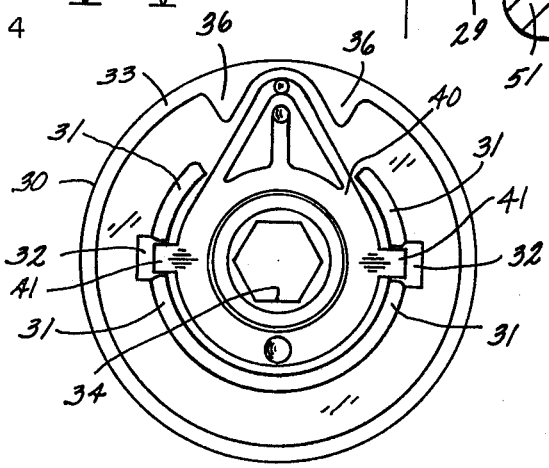
FIG. 3 is an elevational plan view of the underside of the knob of the variable resistance control shown in FIG. 1.

The external surface of the knob 30 is provided with a minimum of externally extending protrusions to protect against unintentional rotation of the knob 30 once the position of the control 10 has been set. Further to accomplish this objective, a stop mechanism normally disposed outside the knob for a variable resistance control of this type is disposed inside the knob. The stop mechanism comprises a tongue 15 (see FIG. 2) bent inwardly from the bracket 11 and extending through a slotted aperture 24 and beyond the surface of the resistance element 21. The location of the tongue 15 is shown on phantom in FIG. 4. A pair of spaced apart fingers 36 extend radially inwardly from the inner surface of the skirt 33 (see FIG. 3). The fingers 36 travel in an interference path with the tongue 15 upon rotation of the knob 30 with each of the fingers 36 providing a stop in one direction of rotation only.

Figure 4:
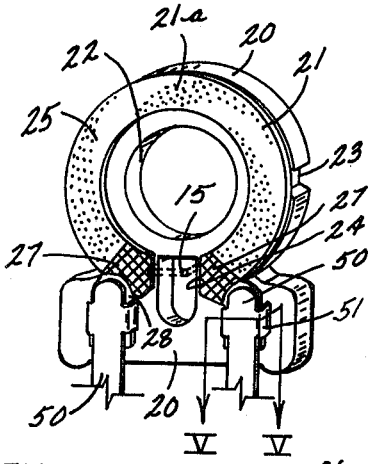
FIG. 4 is an isometric view of the resistor forming part of the control shown in FIG. 1 employing the features of the present invention.
Figure 5:
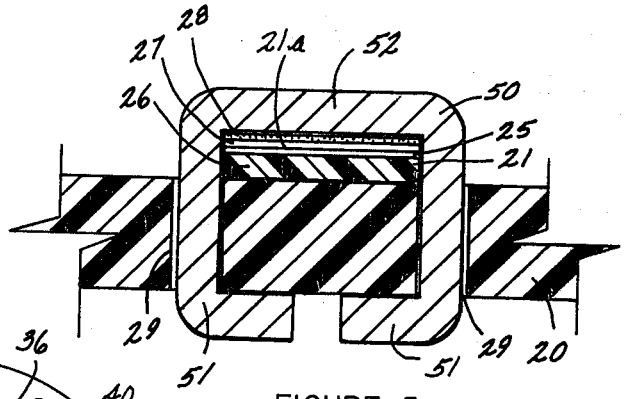
FIG. 5 is a sectional view taken generally along lines V—V of FIG. 4.

Referring to FIGS. 4 and 5 and, in accord with the present invention, a portion of each of the terminals 50 is bonded to the resistance element 21. The top surface of the resistance element 21 defines a path 21*a* and comprises a resistive carbon film 25 applied to a phenolic base 26. The composition of the film 25 and the method of applying such are old in the art. A conductive pad 27 is applied in a suitable manner well known in the art to the terminal ends of the resistance element 21. The conductive pad 27 is formulated from silver or other suitable conductive material. A conductive thermoplastic bondable material 28 is then applied over the conductive pad 27. The terminal 50, having spaced apart parallel extending ears 51 received in apertures 29 in the base 20, secures the resistance element 21 to the base 20. The ends of the ears 51 are folded against the portion of the base 20 thereby securing the terminal 50 to the resistance element 21 in abutting engagement with the bondable material 28.

More specifically, the bondable material 28 comprises conductive particles admixed with a thermoplastic such as polyvinyl acetate, acrylic, cellulose nitrate, or polyamide. The thermoplastic, generally a powder, is mixed with a liquid vehicle including solvents such as ketone, aliphatic, fluorinated, aromatic, or chlorinated hydrocarbon solvents, the solvent selected depending on the thermoplastic. It is, however, not necessary to use a solvent as the liquid vehicle since a nonsolvent such as water is also useable. The particle size of the powder is not critical when a solvent is used as the vehicle, the larger sizes being more difficult to dissolve. A particle size of .003 inch or less provides satisfactory results regardless of the type of vehicle used. A mixing ratio of one part thermoplastic to four parts vehicle by weight provides a low viscosity medium suitable for spraying. It should be noted that other application means may be used, i.e., roll coating or dipping, permitting a higher viscosity medium and use of a larger particle size of the powder.

In accord with the present invention, the conductive particles are added to the thermoplastic and the liquid vehicle and comprise graphite, silver flake, carbon black, copper, or nickel powder and combinations thereof. The size of the conductive particles depends upon the type of application means used; however, when the bondable material 28 is sprayed onto the resistance element 21, the particle size preferably should be .003 inch or less with a mixing ratio of two parts conductive particles to one part thermoplastic. The proper choice of conductive particles depends upon the type of thermoplastic and solvent used to make the bondable material. When silver flake is used, the ratio of conductive particles to thermoplastic preferably is increased to four to one by weight as the silver flake has less volume but is more conductive. The mixture should be well mixed to obtain a uniform dispersion to prevent separation.

The thermoplastic material is mixed with the conductive particles in the following proportions (percentages by weight):

| | Permissible Proportions | Preferable Proportions |
|---|---|---|
| Thermoplastic Material | 10 - 90 | 20 - 50 |
| Conductive Particles | 10 - 90 | 50 - 80 |

After the bondable material 28 is applied to the resistance element 21, the resistance element is cured in a manner typical for a carbon element, i.e., at 190° to 240° C for ½ hour to 2 hours. The carbon element can be cured first and then the bondable material 28 applied, but this method would require extra operations. It is more convenient to apply all of the materials at one time on the base as the conductive bondable material 28 is not adversely affected by the curing temperatures of the carbon element. For this reason, the solderable paints and epoxy formulations are applied after the curing process as they can not withstand the full carbon film cure without deterioration.

As best shown in FIG. 5 of the drawings, the end portion 52 of the terminal 50 abuttingly contacts the conductive bondable material 28. The bondable material, being thermoplastic, will flow when heated and bond the inner surface of the end portion 52 of the terminal 50 to the conductive pad 27 which is bonded to the resistance film 25. The terminal may be heated by suitable means such as a soldering iron, induction heating, or the like. In the preferred method, heating is obtained by passing a current through the terminal. A current of approximately 100 amperes is passed from the end portion 52 through the ends of ears 51 beneath the base 20 for approximately one quarter of a second at a voltage of five to six volts of either AC or DC. The temperature of the end portion 52 in contact with the bondable material reaches approximately 250° C, a temperature of 300° C being preferred to assure quality on a production line.

In the preferred embodiment, the thermoplastic is polyamide, the solvent is acetone and the conductive particles are silver flake. It should be noted that the bondable material 28, being thermoplastic, is reheatable without adversely affecting the bond. Additionally, with the use of the bondable material 28, the composition of the terminal 50 is not limited to materials and platings that are solderable.

While there has been illustrated and described what is at present considered to be a preferred embodiment of the present invention and a method of making the same, it will be appreciated that numerous changes and modifications are likely to occur to those skilled in the art, and it is intended in the appended claims to cover all those changes and modifications which fall within the true spirit and scope of the present invention.

What is claimed as new and desired to be secured by Letters Patent of the United States is:

1. A variable resistance control comprising an apertured base having a surface, an arcuate resistance path provided on the surface of the base, a collector carried by the base in spaced relationship to the resistance path, a knob rotatably supported relative to the base, a first skirt extending from the knob and slideably engaging the base and spacing the knob from the base, a contactor constrained to rotate with the knob, the contactor wipably engaging and electrically connecting the collector and the resistance path intermediate the ends thereof, and a second skirt integral with one of the knob and the base and disposed outwardly from the first skirt and extending towards the periphery of the other of the knob and the base, the peripheral portions of the knob and the base and the outer surface of the first skirt defining an annular channel, the second skirt radially enclosing the annular channel.

2. The control of claim 1, wherein the second skirt slideably engages the base, the force exerted by the second skirt against the base being substantially less than the force exerted by the first skirt slideably engaging the base.

3. The control of claim 1, wherein the arcuate resistance path is disposed along the peripheral portion of the base defining the annular channel, and the contactor wipably engaging the resistance path projects through an opening provided in the first skirt.

4. The control of claim 1, wherein a stop member is integral with the knob and extends toward the surface of the base, and a stop protrusion extends from the collector toward the knob, the protrusion being disposed radially inwardly from the second skirt and in an interference path with the stop member for limiting travel of the contactor along the resistance path.

5. The control of claim 1, wherein a terminal is electrically connected to each of the ends of the arcuate resistance path and fixedly secured to the base, and a conductive thermoplastic material bonds a portion of the terminal to the resistance path.

6. The control of claim 5, wherein the bonding material comprises conductive particles and polyamide.

7. A resistor, a resistance element for a variable resistance control or the like comprising a base, a resistance path provided on a surface of the base, a bonding material adhered to a predetermined portion of the resistance path, and a terminal mechanically secured to the base, a portion of the terminal abuttingly engaging the bonding material and adhered thereby to the resistance path, the bonding material being sandwiched between the portion of the terminal and the surface of the base and comprising a thermoplastic material admixed the conductive particles.

8. The resistor of claim 7, wherein the thermoplastic material is selected from the group consisting of polyvinyl acetate, acrylic, cellulose nitrate and polyamide.

9. The resistor of claim 7, wherein a conductive pad is secured to a portion of the resistance path, the resistivity of the conductive pad being substantially less than the resistivity of the resistance path, the bonding material being adhered to the conductive pad.

* * * * *